United States Patent [19]

Hayes

[11] Patent Number: 4,480,649

[45] Date of Patent: Nov. 6, 1984

[54] FILTER DEVICE

[76] Inventor: Ernest B. Hayes, 14 Heath Ct., Leighton Buzzard, Bedfordshire LU7 7JR, United Kingdom

[21] Appl. No.: 391,301

[22] Filed: Jun. 23, 1982

[30] Foreign Application Priority Data

Jul. 6, 1981 [GB] United Kingdom ..... 8120820

[51] Int. Cl.[3] ..... A24D 3/04

[52] U.S. Cl. ..... 131/336; 131/338; 131/339; 131/361; 493/39; 493/47

[58] Field of Search ..... 131/336, 365, 361, 340, 131/339, 338; 493/46, 47, 34

[56] References Cited

U.S. PATENT DOCUMENTS

| | | | |
|---|---|---|---|
| 3,490,461 | 1/1970 | Osmalov et al. | 131/336 |
| 3,596,663 | 8/1971 | Schultz et al. | 131/336 |
| 4,338,956 | 7/1982 | Sanford et al. | 131/361 |
| 4,357,950 | 11/1982 | Berger | 131/349 |

FOREIGN PATENT DOCUMENTS

| | | |
|---|---|---|
| 1276117 | 6/1972 | United Kingdom . |
| 1358685 | 7/1974 | United Kingdom . |
| 1488972 | 10/1977 | United Kingdom . |

*Primary Examiner*—Vincent Millin

*Attorney, Agent, or Firm*—Holman & Stern

[57] ABSTRACT

This invention provides a cigarette filter comprising a filter core (2), a plugwrap (4) around the core, a profiled spacer wrap (6) around the plugwrap, and tipping material (8) around the spacer wrap, the profiled spacer wrap providing between the plugwrap and tipping material passages (14,16) which are in lateral air flow communication and extend longitudinally of the filter to open at an end thereof, the tipping material providing in use of the filter for the drawing of external air therethrough directly into at least some of the said passages, and the plugwrap beneath the passages being smoke-impermeable. The spacer wrap may be longitudinally corrugated to provide adjacent longitudinal passages (14,16) which are in air flow communication via apertures (15) through the side walls of the corrugations.

6 Claims, 5 Drawing Figures

FILTER DEVICE

The present invention relates to cigarette filters and provides a cigarette filter comprising a filtering core, a sleeve around the core, a profiled spacer wrap around the sleeve, and tipping material around the spacerwrap, the profiled spacer wrap providing between the sleeve and tipping material passages which are in lateral air flow communication and extend longitudinally of the filter to open at an end thereof, the tipping material providing in use of the filter for the drawing of external air therethrough directly into at least some of the said passages, and the sleeve at least beneath the passages being smoke-impermeable.

The profiled spacer wrap may for example be longitudinally corrugated to provide first such longitudinal passages between itself and the tipping material and second such longitudinal passages between itself and the sleeve, the tipping material providing for the drawing of external air therethrough directly into first passages, and adjacent first and second passages being in air flow communication by virtue of the air permeability of the material of the spacer wrap and/or via apertures through the side walls of the corrugations. Other spacer wrap profiles are possible; for example the spacer wrap may be embossed with dimples to provide between itself and the tipping material a network of interconnecting passages extending, like the first and second passages of the previously mentioned embodiment, from an end of the filter, the tipping material providing for the drawing of external air therethrough directly into the network. In some embodiments, the communicating passages may extend from one end through to the other end of the filter, or may terminate short of the other end, e.g. at a region of the spacer wrap which is plain or appropriately configured (e.g. with circumferentially extending corrugations) to close off the said passages. The tipping material may be inherently air-permeable, and/or may have perforations opening into at least some of the passages. The tipping material may be a tipping overwrap joining the filter to a wrapped tobacco rod and in this case will usually be of air-impermeable material with ventilation perforations therethrough. Where the said passages extend from one end of the filter only partially towards the other, the filter may be incorporated in a filtered cigarette with the passages open at the buccal end or open towards the tobacco. In the former case diluting ventilation air will be drawn through the passages directly into the smokers mouth before mixing with the smoke; in the latter case the air will be drawn first to the tobacco end of the filter and then back through the length of the core, mixing with the smoke in the core. In other embodiments the filter has some said passages extending from each end only partially towards the other, the two sets of passages being terminated for example at a common intermediate region along length of the filter, and in this case some ventilation air will be drawn directly into the smokers mouth and some via the full length of the filtering core. In addition to and separate from the air dilution passages beneath which the sleeve is smoke-impermeable, a filter according to the invention can have a further passage or passages provided by the profiled spacer wrap and in smoke-flow communication with the core, e.g. through an aperture or apertures through the underlying sleeve or where the sleeve is missing.

The invention also provides a cigarette filter element which is a filter as defined above with the tipping material omitted, i.e. with the profiled spacer wrap exposed. Such a filter element can be joined end to end with a wrapped tobacco rod by means of a ventilating tipping overwrap which constitutes the tipping material of the resulting completed filter.

In filters and filter elements according to the invention, the sleeve around the core may for example be a plugwrap or an integral skin of the core.

The filtering core may be of a variety of materials and constructions. The core may for example be of bonded or unbonded staple fibres or filamentary tow (of cellulose acetate, or polyolefin etc), creped paper, or air-permeable cellular material. The core may be of uniform or non-uniform structure and composition along its length; it may be integral or of composite structure—e.g. having separate plugs of the same or differing characteristics (e.g. pressure drop) and/or composition; the core may extend wholly or only partially the length of the element or filter; and where the core is a composite of two or more plugs adjacent plugs may abut or be spaced apart. The core may incorporate particulate additive uniformly dispersed therethrough or localised in at least one region or inter-plug space; the core may have a profiled (e.g. longitudinally grooved) periphery, and it may have one or more internal passages or cavities which may be filled or unfilled. The core may include one or more components which do not have a filtering effect but which merely serve to increase the pressure drop; and there may be used as or in the filtering core of elements and filters according to the invention a high pressure drop, low retention plug of gathered coarse fibres or of gathered embossed plastics, metal (e.g. aluminium) or other foil. In some embodiments the spacer wrap surrounds a cavity or recess open at an end of the filter element or filter, and in use a recess or cavity may be disposed against the wrapped tobacco rod or exposed at the buccal end of the filtered cigarette.

Elements according to the invention are suitably made by first forming the sleeved core (as a continuous or discrete finite length rod), profiling (e.g. corrugating) the spacer wrap to the required configuration, and wrapping and securing the profiled spacer wrap around the core; tipping material may subsequently be wrapped around the spacer wrap; this tipping material may be the tipping overwrap which is employed to join element and tobacco rod together during formation of filter cigarettes in conventional manner.

Normally the sleeved core will be formed as a continuous rod which is then continuously wrapped in the pre-profiled spacer wrap, the resulting continuous composite then being cut transversely into finite lengths. A wrap of air-permeable material may if desired be applied continuously around the composite of sleeved core and profiled wrap before the cutting into finite lengths. For filter cigarette manufacture, a double length such product is disposed with a wrapped tobacco rod abutting either end, ventilating tubbing overwrap is applied to join the tobacco rods and intervening element or filter rod together, and the resulting combination is cut in half to produce two filter cigarettes. The initially produced continuous filter or element is normally cut into even multiple (e.g. sextuple) length units for supply to the filter cigarette manufacturer who then cuts these multiple lengths into double lengths for use in filter cigarette production as described above. It will be appreciated that, in the case of individual filter or element lengths according to the invention whose two ends differ, e.g. in which the passages extend from one end only to terminate short of the other end, the initial even multiple length rods supplied by the filter manufacturer and from which the individual lengths are eventually formed can have identical ends—e.g. the even multiple length rod could have passages extending from both ends or closed at both ends, according to whether the passages in the final filter cigarette are to be open to the tobacco or at the buccal end respectively. Double and multiple length rods also form part of the present invention.

The invention is illustrated, by way of example only, with reference to the accompanying drawings, in which like reference numerals denote like parts and in which.

Figure 1:
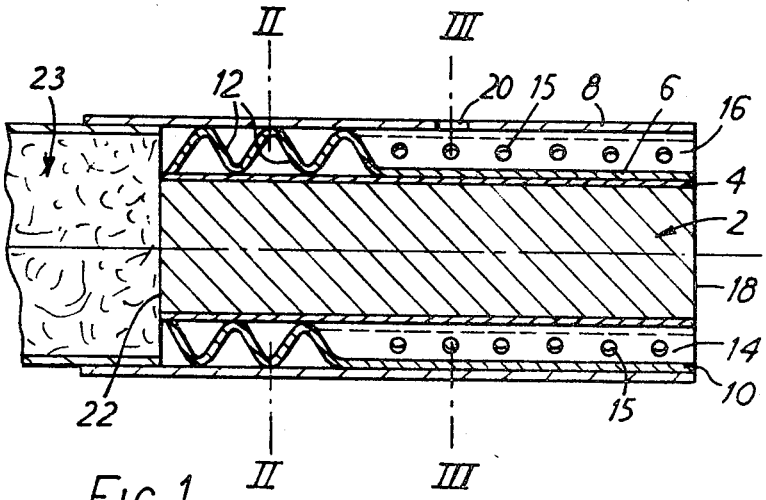
FIG. 1 is a longitudinal sectional view, at lines I—I of FIG. 3, through a filter and filter element according to the invention, incorporated in a filtered cigarette according to the invention.
Figure 2:
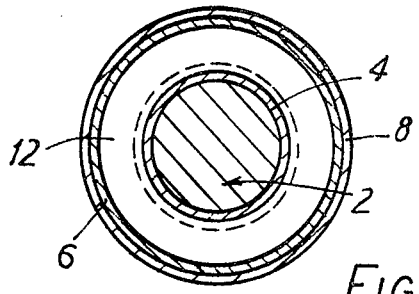
FIG. 2 is a sectional view at II—II of FIG. 1.
Figure 3:
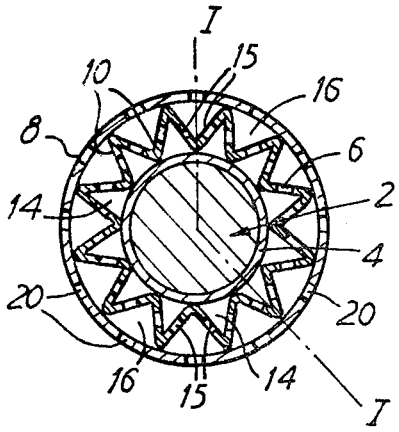
FIG. 3 is a sectional view at III—III of FIG. 1.

The filter element illustrated in FIGS. 1 to 3 consists of a filter core 2 of filtering material wrapped in a smoke-impermeable plugwrap 4, and a profiled spacer wrap 6 in surrounding engagement with plugwrap 4. The profiled wrap 6 has longitudinal corrugations 10 closed at one end 22 of the element by circumferential corrugations 12, the longitudinal corrugations 10 providing passages 14 between plugwrap 4 and profiled wrap 6 and outer passages 16 in the external face of profiled wrap 6, these passages 16 in the completed filtered cigarette being between the profiled wrap 6 and tipping overwrap 8 which joins the filter element to a wrapped tobacco column 23 at end 22. Tipping material 8 is of smoke-impermeable material and has a circumferential ring of perforations 20 via which passages 16 are in communication with the external air. Passages 16 are also in communication with passages 14 through the apertures 15 in the walls of the longitudinal corrugations, and passages 16 and 14 are also open at the end 18 of the filter.

The profiled wrap 6 is of air-impermeable material, e.g. a paper/thermoplastics polymer/paper laminate (the polymer preferably being a polyolefin such as polyethylene) embossed with the illustrated longitudinal and transverse corrugations, and is secured around the plugwrap 4 by a conventional lapped and stuck seam; it may also be adhered to plugwrap 4 along one or more longitudinal gum lines. Profiled wrap 6 does not compress the core or impress its pattern into its surface.

The core 2 may be of any conventional smoke filtering material(s) and construction.

In smoking of the illustrated filtered cigarette, drawing on the mouth end causes external air to pass through perforations 20 into passages 16, thence via apertures 15 into passages 14, and along passages 16 and 14 to the mouth end 18 so that the ventilating air passes directly into the smokers mouth before mixing with the inhaled smoke. The filter could instead be attached to tobacco rod 23 at end 18; in this case, drawing on the mouth end 22 causes external air to flow in through perforations 20 into passages 16, through apertures 15 into passages 14, along passages 16 and 14 to the end 18 of the filter, and then back through the core 2 from end 18 to end 22, diluting the smoke passing through the filter.

Figure 4:
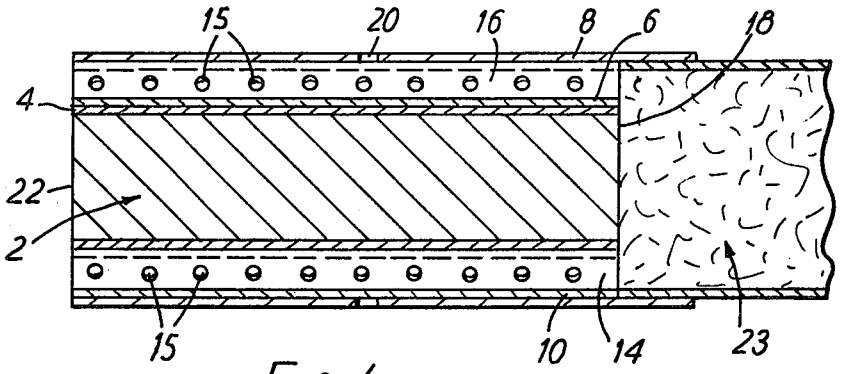
FIG. 4 is a longitudinal sectional view, similar to that of FIG. 1, of another filter and filter element according to the invention incorporated in a filtered cigarette according to the invention.

In the embodiment illustrated in FIG. 4, the corrugations 10, and hence the passages 16 and 14, extend the full length of the filter from end 18 to end 22. In this case some smoke can enter directly into the passages 16 and 14 where these abut the tobacco. The materials of the core 2, impermeable plugwrap 4, profiled spacer wrap 6 and tipping overwrap 8 may be the same as for the embodiment of FIGS. 1 to 3.

Figure 5:
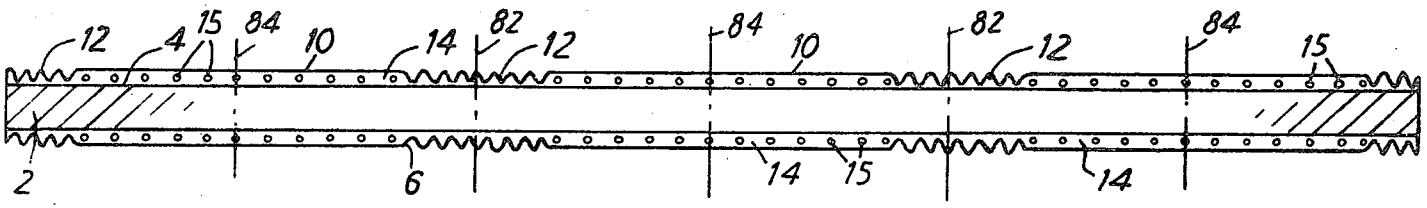
FIG. 5 is a schematic longitudinal sectional view of a multiple length element according to the invention.

As previously explained, a filter element according to the invention such as any of those illustrated will initially be produced in a continuous length from which even multiple length rods (i.e. each rod being an even multiple of the eventual individual element) are cut, the multiple length rods subsequently being further subdivided into double length elements and then, during filter cigarette production, into the final single length elements. FIG. 5 shows a sextuple length rod according to the invention from which single elements as in FIG. 1 can be produced by cutting firstly at positions 82 to yield double length rods and then, after application of tipping overwrap during filter cigarette manufacture as described above, at positions 84. FIG. 1 filter cigarettes would thus be obtained.

The invention thus also provides a method of making the smoke filter elements herein which comprises forming the sleeved filtering core, profiling the spacer wrap to the required configuration, and then wrapping and securing the profiled spacer wrap around the sleeved core to provide the said passages. It also provides a multiple length filter element rod comprising a plurality of unit elements as defined herein disposed end-to-end and integrated by a common said spacer wrap extending the full length of the rod, each said unit element being disposed in mirror-image relationship to the or each integrally adjacent unit element. A filter element according to the invention comprises a filter core, a sleeve around the core, and a profiled spacer wrap around the sleeved core, the profiled spacer wrap providing passages externally and internally thereof passages which extend longitudinally of the element to an end thereof and which are in lateral air flow communication with one another, and the sleeve at least beneath the passages being smoke-impermeable.

It will be appreciated that FIGS. 1 to 5 are not to scale and that in FIGS. 1 to 4 especially the depth of corrugations 10 compared to the diameter of core 2 is much exaggerated for clarity; in practice the core 2 and plugwrap 4 will occupy substantially the whole of the cross section of the filter (whose overall diameter would be about 8 mm), with the corrugations 10 being for example only about 0.25 to 1 mm. deep, e.g. 0.5 mm, and giving about 44 passages 14, 16.

In filter elements and filters according to the invention the smoke-impermeable plugwrap or plugwrap portion may be localised to the region or regions beneath the said passages. In all embodiments, the smoke-impermeable plugwrap may take the form of an integral smoke-impermeable (e.g. heat- or solvent-fused) skin of the core, this skin likewise being localised, if desired, to the region or regions beneath the said passages.

Filter elements and filters according to the invention may include their own plain outer wrap of air-permeable and/or perforate material, and could then be incorporated in filtered cigarettes by means of ring tipping.

What is claimed is:

1. A filter element comprising a filter core, a sleeve around the core, a profiled spacer wrap around the sleeve, and tipping material around the spacer wrap, the profiled spacer wrap providing between the sleeve and tipping material passages which are in lateral air flow communication and extend longitudinally of the filter to open at an end thereof, the tipping material providing in use of the filter for the drawing of external air therethrough directly into at least some of the said passages, and the sleeve at least beneath the passages being smoke-impermeable, wherein the spacer wrap is longitudinally corrugated to provide such longitudinal passages between itself and the tipping material and second such longitudinal passages between itself and the sleeve, the tipping material providing for the drawing of external air therethrough directly into first passages, and adjacent first and second passages being in air flow communication by virtue of the air permeability of the material of the spacer wrap and/or via apertures through the side walls of the corrugations.

2. A filter element comprising a filter core, a sleeve around the core, a profiled spacer wrap around the sleeve, and tipping material around the spacer wrap, the profiled spacer wrap providing between the sleeve and tipping material passages which are in lateral air flow communication and extend longitudinally of the filter to open at an end thereof, the tipping material providing in use of the filter for the drawing of external air therethrough directly into at least some of the said passages, and the sleeve at least beneath the passages being smoke-impermeable, wherein the spacer wrap is dimpled to provide between itself and the tipping material a network of interconnecting passages extending from an end of the filter, the tipping material providing for the drawing of external air therethrough directly into the network.

3. A filter according to claim 2 wherein at least some said passages in air flow communication extend from one end of the filter through to the other end of the filter.

4. A filter according to claim 2 wherein at least some of said passages in air flow communication terminate short of the other end of the filter.

5. A filter according to claim 2 wherein said tipping material comprises a tipping overwrap incorporating said filter in a filter cigarette.

6. A method of making a smoke filter element of the type comprising a filter core, a sleeve around the core, and a profiled spacer wrap around the sleeve core, the profiled spacer wrap providing passages externally and internally thereof passages which extend longitudinally of the element to an end thereof and which are in lateral air flow communication with one another, and said sleeve at least beneath the passages being smoke-impermeable, said method comprising the steps of forming the sleeved filtering core, profiling the spacer wrap to the required configuration, and then wrapping and securing the profiled spacer wrap around the sleeve core to provide the said passages.

* * * * *